US005323797A

United States Patent [19]

Rankin

[11] Patent Number: 5,323,797

[45] Date of Patent: Jun. 28, 1994

[54] ROTATING HOSE APPARATUS

[76] Inventor: George J. Rankin, 13103 Barryknoll Ln., Houston, Tex. 77079

[21] Appl. No.: 927,128

[22] Filed: Aug. 7, 1992

[51] Int. Cl.[5] ..... B08B 3/02

[52] U.S. Cl. ..... 134/167 C; 134/169 C; 134/172; 134/181

[58] Field of Search ..... 134/95.1, 98.1, 104.2, 134/103.1, 96.1, 167 C, 169 C, 168 C, 172, 181

[56] References Cited

U.S. PATENT DOCUMENTS

| | | | |
|---|---|---|---|
| 2,735,794 | 2/1956 | Pletcher | 134/167 C |
| 3,866,677 | 2/1975 | Laky | 134/167 C |
| 3,987,963 | 10/1976 | Pacht | 134/167 C |
| 4,349,073 | 9/1982 | Zublin | 134/167 C X |
| 4,691,723 | 9/1987 | Mierswa et al. | 134/168 C |
| 4,715,538 | 12/1987 | Lingnau | 134/167 C |
| 4,844,021 | 7/1989 | Stross | 134/167 C |

*Primary Examiner*—Frankie L. Stinson

*Attorney, Agent, or Firm*—Alton W. Payne; David M. O'Brian

[57] ABSTRACT

A rotating hose device for rotating and helically thrusting a high pressure hose and biased nozzle into a pipe for the purpose of cleaning the interior surface of the pipe. The rotating hose device is powered by converting linear torque from a rotating high pressure hose into linear thrust, forcing the high pressure hose and biased nozzle into the pipe, where the high pressure hose and biased nozzle travel through the pipe in a helical manner. The present invention more effeciently cleans conduit, pipe and other tubular members, by constantly positioning the biased nozzle against the interior surface of the pipe and avoiding the "streaking" effect left by prior art nozzles. The helical pitch of the rotating high pressure hose, speed and direction of travel of the high pressure hose are controlled through the alignment of the drive wheels in the rotary hose drive.

9 Claims, 9 Drawing Sheets

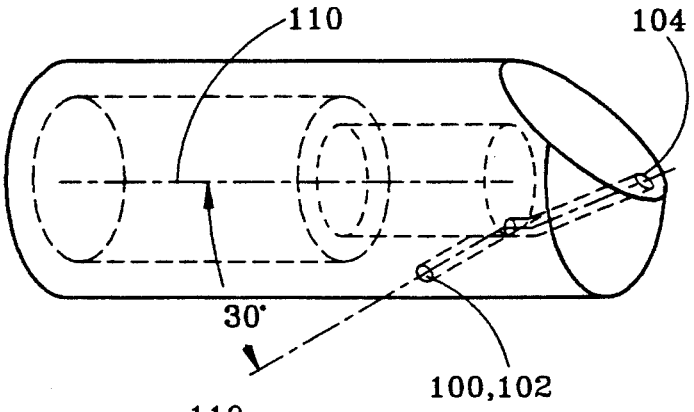
FIG.7B
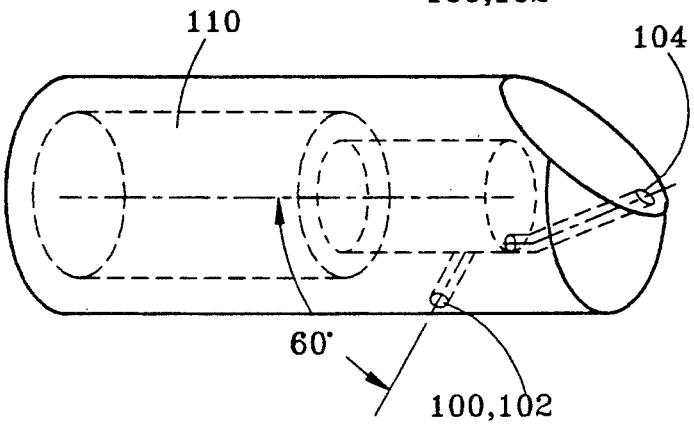
FIG.7A
FIG.8A
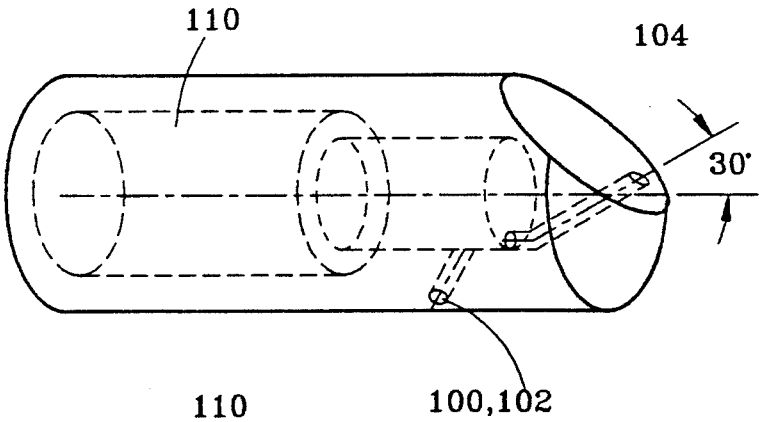
FIG.8B
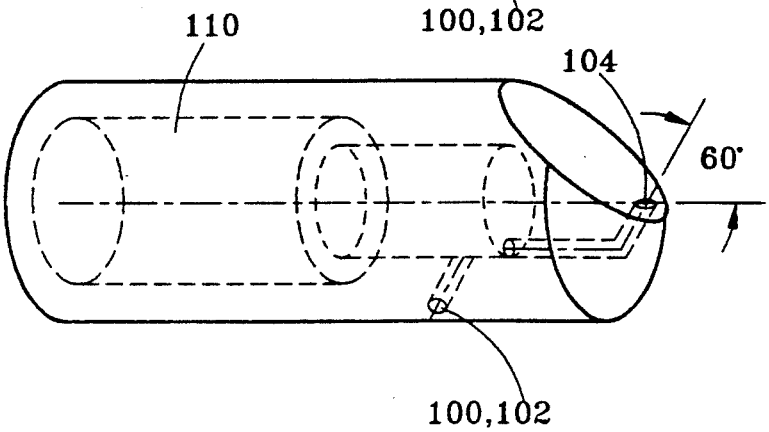

ROTATING HOSE APPARATUS

FIELD OF THE INVENTION

The present invention relates generally to cleaning the internal surface of conduits or pipes. Specifically, the present invention relates to a rotating hose apparatus for thrusting a high pressure, rotating fluid bearing hose and cleaning nozzle into a pipe to remove tough, hard or brittle deposits or coatings from the interior surface of the pipe.

BACKGROUND OF THE INVENTION

Effectively and effeciently cleaning plugged or partially plugged conduit, pipe or assorted tubular members continues to be a major problem. Keeping industrial, commercial and residential piping clean and avoiding the problem of "streaking" or leaving an uncleaned or partially cleaned path is an ongoing concern which costs hundreds of millions of dollars annually in this country alone. Plugged residential piping is a nuisance and inconvenience to the home dweller and can become costly if improperly handled. Plugged commercial and industrial piping is more than a nuisance or inconvenience. Plugged commercial and industrial piping is costly in terms of lost production and lost profits to the company, lost or reduced wages to the workers and the costly expense of cleaning and maintaining the piping.

Of primary concern in the present invention is to provide a more efficient, less expensive, safer and easier to use system to clean and maintain the internal surface of industrial, commercial and residential piping.

It is, therefore, a feature of the present invention to provide a cleaning operation which is automatic and thereby reduces the cleaning time compared to manual prior cleaning techniques.

A feature of the present invention is to provide an independent set of controls for forward or backward speed, and rotational speed to control the size particles removed from the internal surface of the piping.

Another feature of the present invention is to provide a safer system of cleaning the interior surface of piping, in that the operator need not be in close proximity to the pipe opening or the rotating hose.

Another feature of the present invention is to provide a hydraulic, or other non-internal combustion, powered rotating device which can be safely used in hazardous or explosive environments, where an internal combustion engine could not safely operate.

Yet another feature of the present invention is to provide rotating, helical or screw-like insertion of the high pressure hose and nozzle into the pipe, which greatly reduces the amount of streaking on the interior surface of piping.

Yet another feature of the present invention is to provide an internal pipe cleaning system which is light and portable permitting its use in many small or elevated work areas.

Still another feature of the present invention is to provide an internal pipe cleaning apparatus which can be used in piping of wide ranging diameters, with comparatively small water blast equipment.

Yet further, an additional feature of the present invention is to provide a safe internal pipe cleaning apparatus whereby, should the high pressure hose burst or the nozzle become separated from the high pressure hose, the hose will not uncontrollably retreat from the piping.

Still another feature of the present invention is to convert the torque from the rotating hose into linear thrust, to thrust the high pressure hose forward or backward, and to use the same linear thrust to control the speed with which the hose and nozzle are inserted into the pipe.

Yet another feature of the present invention is to control the helical pitch at which the hose and nozzle are inserted into a pipe, to provide more effecient cleaning.

Another feature of the present invention is to employ a biased cleaning nozzle which is designed to press itself against the interior surface of the pipe to more effectively clean the interior surface and not attempt to position itself centrally within the pipe as do prior art nozzles.

Yet still another feature of the present invention is to provide an apparatus for cleaning the interior surfaces of pipe more effectively and more efficiently than other currently known devices.

Additional features and advantages of the invention will be set forth in part in the description which follows, and in part will become apparent from the description, or maybe learned by practice of the invention. The features and advantages of the invention maybe realized by means of the combinations and steps particularly pointed out in the appended claims.

SUMMARY OF THE INVENTION

To achieve the foregoing objects, features, and advantages and in accordance with the purpose of the invention as embodied and broadly described herein, a rotating hose device is provided for more effectively and effeciently cleaning the interior surface of industrial, commercial and residential piping. A rotating hose device is used to thrust and rotate high pressure hose and a biased nozzle inside the pipe to be cleaned. The biased cleaning nozzle rotates through the interior portion of the pipe and advances in a helical path. The biased cleaning nozzle eliminates the streaking left from known pipe cleaning systems.

The present invention removes deposits, debris and coatings from concrete, PVC, steel and many other pipe materials with minimum damage to the pipe itself. In particular, the present invention is especially useful in cleaning heat exchanger tubes in areas with limited access. The present invention can normally negotiate bends in piping systems and can clean pipe up to fifteen hundred feet in length. Flexible high pressure hose withstanding pressures of 60,000 PSI can be used in pipe diameters ranging from 0.4 inches to 240 inches. The present invention is comparatively light and portable allowing for its use in many small or elevated work areas. The rotational speed, rotational direction, pressure and fluid flow are remotely and independently controllable away from the entrance to the pipe and the rotating hose, providing additional safety to the operator.

A rotating, high pressure hose having a biased cleaning nozzle is inserted helically into the pipe at a non-parallel angle ranging from slightly greater than 0° to slightly less than 90°, relative to the longitudinal axis of the pipe. By entering the pipe at anon-parallel angle relative to the longitudinal axis of the pipe, the biased cleaning nozzle and high pressure hose are forced to enter the pipe in a helical manner and maintain their travel through the pipe in a helical manner. The jetting forces from the biased nozzle, keep the nozzle pressed against the interior surface of the pipe and provide for the elimination of streaking and less damage to the interior surface of the pipe. By using a high pressure hose and biased cleaning nozzle in a rotating, helical manner, the time required to clean interior pipe surfaces is greatly reduced from the methods and apparatus currently used, and with better results.

BRIEF DESCRIPTION OF THE DRAWINGS

The accompanying drawings which are incorporated in and constitute a part of the specification, illustrate a preferred embodiment of the invention and together with the general description of the invention given above and the detailed description of the preferred embodiment given below, serve to explain the principles of the invention.

FIG. 7(A–B) illustrates embodiments of the bias nozzle of the present invention with differing jet positions.

FIG. 8(A–B) illustrates embodiments of the bias nozzle of the present invention with differing jet positions.

The above general description and the following detailed description are merely illustrative of the generic invention, and additional modes, advantages, and particulars of this invention will be readily suggested to those skilled in the art without departing from the spirit and scope of the invention.

DETAILED DESCRIPTION OF THE PREFERRED EMBODIMENTS

Reference will now be made in detail to the present preferred embodiments of the invention as described in the accompanying drawings.

Figure 1:
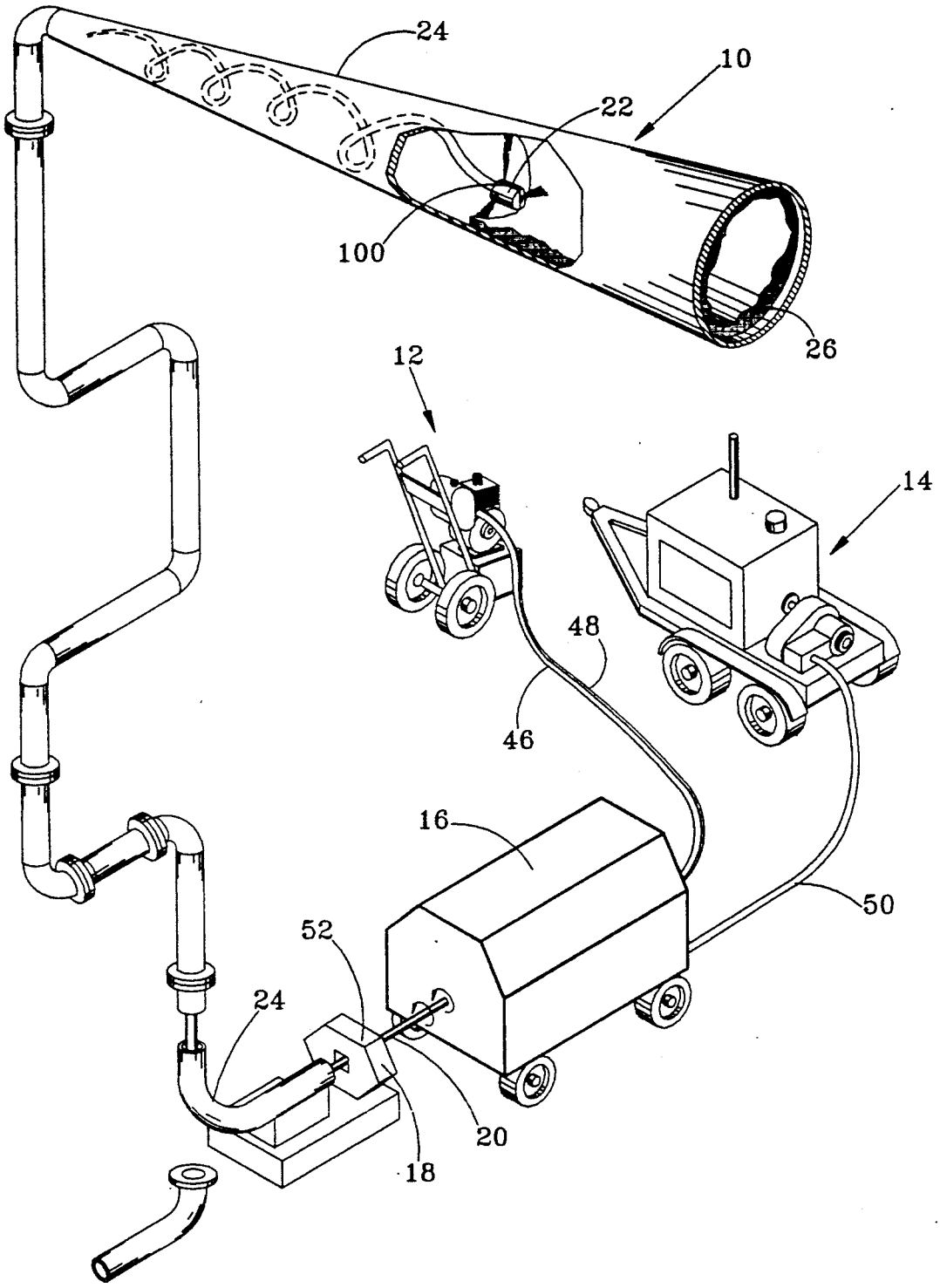
FIG. 1 is a perspective view of the present invention, showing the relationship of the component parts.

FIG. 1 is a perspective view of the rotating hose apparatus 10, including an Aqua-Dyne D40277-42 portable hydraulic power unit 12, an Aqua-Dyne C-Series high pressure pump 14, a rolling platform 16, a rotary hose drive 18, a high pressure hose 20, a bias cleaning nozzle 22, a pipe 24 and scale, coatings, brittle or hard deposits, or other debris 26 which accumulates on the interior surface of the pipe 24.

Figure 2:
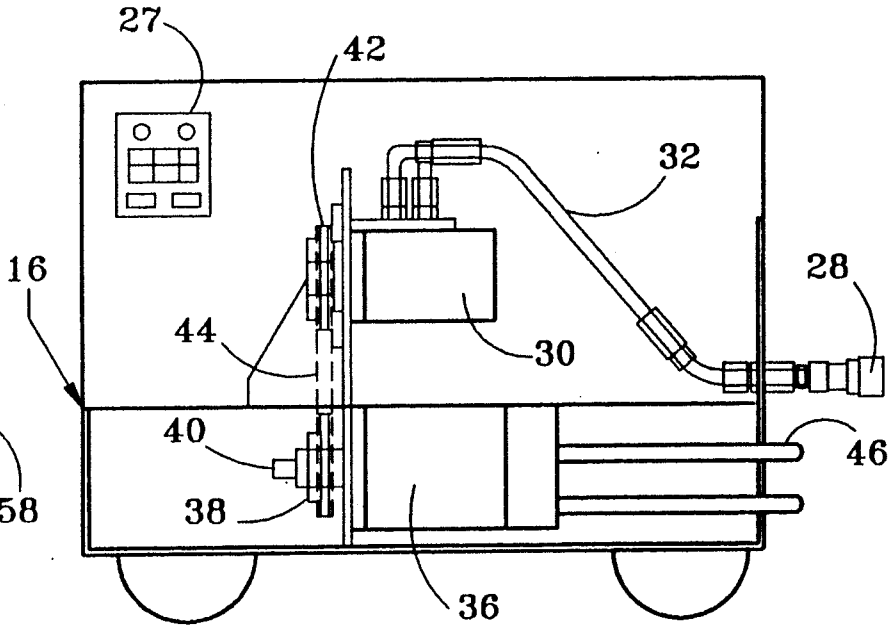
FIG. 2 is a cross-sectional end view of the rolling platform which houses the rotary union drive and swivel joint.

FIG. 2 illustrates a cross-sectional side view of the rolling platform 16. The rolling platform 16 employs a control panel 27 to control a high pressure water inlet 28, a rotary union drive 30, a connection hose 32 between an inlet 28 and a rotary union drive 30, a swivel joint 34 to allow the high pressure hose 20 to rotate, a power source 36 to drive a swivel joint 34, a first sprocket 38 which attaches to a drive shaft 40 protruding from a power source 36, a second sprocket 42 which attaches to the swivel joint 34, and a drive chain 44 which engages both sprockets 38, 42 to transfer energy from the power source 36 to the swivel joint 34. A first incoming hydraulic hose 46 brings high pressure hydraulic fluid from the hydraulic power unit 12, to provide energy to the power source 36. A second outgoing hydraulic hose 48 returns hydraulic fluid to the hydraulic power unit 12 to be reused.

Referring to FIGS. 1 and 2, the high pressure hose inlet 28 is engaged to high pressure pump 14 via a high pressure hose 50 which is a standard high pressure hose. The high pressure hose 20 is constructed of a plurality of hose segments, in which the first joint of the high pressure hose 20 has it's female end threadably connected to a swivel joint 34 and the male end of the high pressure hose 20 is threadably connected to the bias nozzle 22. The high pressure hose 20 is centrally engaged with the rotary hose drive 18 and depends through the aperture 52 of the rotary hose drive 18, where the nozzle 22 is inserted into the pipe 24. As the swivel joint 34 begins to rotate the high pressure hose 20 in association with the transfer of energy from the hydraulic power unit 12 to the power source 36, the high pressure hose 20 generates rotary torque which is transfered into linear hose thrust in the rotary hose drive 18. As the rotary hose drive 18 translates the linear hose thrust, the high pressure hose 20 is thrust into the pipe 24 and the rolling platform 16 is drawn toward the rotary hose drive 18. When the rolling platform 16 is within feet, for example 5 to 10 feet, of the rotary hose drive 18, the operator disengages the hydraulic power unit 12, thereby interrupting the power supplied to the swivel joint 34. The female end of the high pressure hose 20 is then disengaged from the swivel joint 34 and a new segment of high pressure hose 20 is added. The male end of the new segment of high pressure hose 20 is threadably connected to the female end of existing portion of the high pressure hose 20. The female end of the new segment of the high pressure hose 20 is threadably connected to the swivel joint 34. Once the new segment of high pressure hose 20 has been added, the rolling platform 16 is rolled back, in the opposite direction from the rotary hose drive 18, taking the slack out of the newly added portion of high pressure hose 20. Having taken out the slack of the newly added portion of high pressure hose 20, the hydraulic power unit 12 is engaged with the power source 36, whereupon the swivel joint 34 rotates the newly added portion of high pressure hose 20 and all prior engaged segments of high pressure hose 20. Numerous sections of the high pressure hose 20 may be added by following the aforementioned procedure. The rolling platform 16 is constantly being drawn to the rotary hose drive 18, when the high pressure hose 20 is both rotating and being thrust into the pipe 24.

Figure 3:
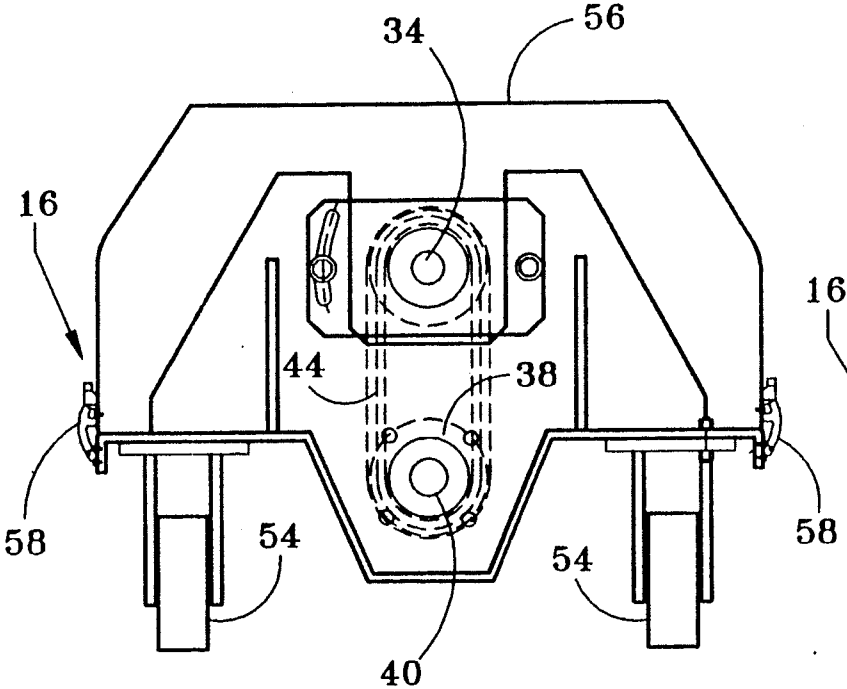
FIG. 3 is a cross-sectional side view of the rolling platform which houses the rotary union drive and swivel joint.

FIG. 3 is a cross-sectional end view of the rolling platform 16. The rolling platform 16 further employs a plurality of casters 54, a cover 56 and a plurality of latches 58 to secure the cover 56 to the platform 16.

Figure 4:
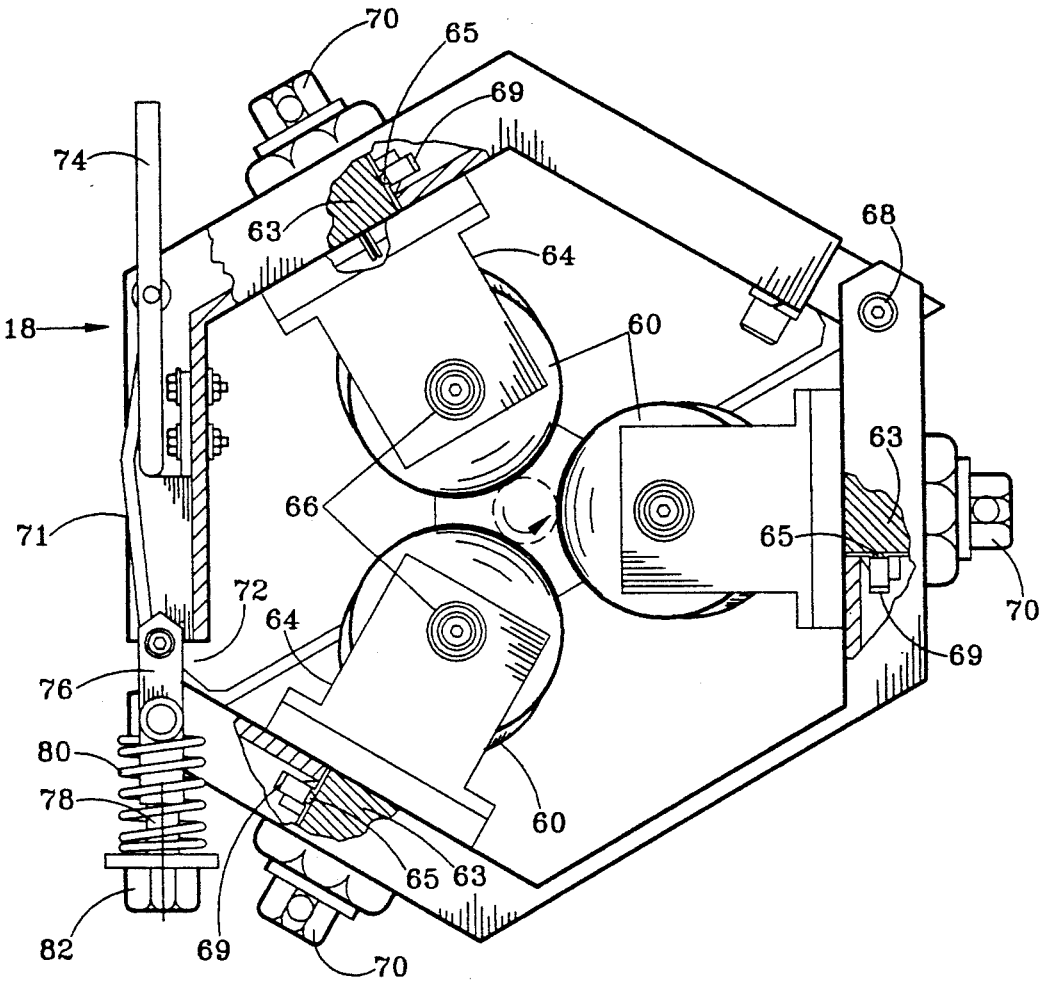
FIG. 4 is a cross-sectional view of the rotary hose drive.

FIG. 4 is a cross-sectional view of the rotary hose drive 18. A plurality of drive wheels 60 are centrally located within the frame 62 of rotary hose drive 18. Drive wheels 60 are pivotally pinned in caster frames 64 using nut, bolt and washer assemblies 66. The rotary hose drive frame 62 is a two piece frame, horizontally divided and hinged at nut, bolt and washer assembly 68. An adjustable spring loaded clamp arm 71 secures the opening 72 in rotary hose drive frame 62. Drive wheels 60 are engagedly affixed to high pressure hose 20 and directly transform the rotary hose torque generated by swivel joint 34 and transferred via high pressure hose 20, into linear thrust to propel the high pressure hose 20 into pipe 24. The caster frames 64 can pivot to align drive wheels 60 to position high pressure hose 20 to enter pipe 24 at a variety of pitch angles to cause high pressure hose 20 to travel through pipe 24 in a helical manner. The caster frames 64 can be pivoted by loosening adjustment bolts 70 and turning the caster frames 64 in the desired direction and then retightening adjustment bolts 70. A plurality of pin rollers 67 are utilized to prevent adjusting bolts 70 from rotating and becoming loose. A plurality of spring plungers 69 are incorporated in the internal caster housing 64 to align a spring loaded pin 65 with a pre-drilled slot 63, for greater ease in adjusting the pitch angle of drive wheels 60. The amount of torque generated by swivel joint 34 and transferred via high pressure hose 20 directly controls the speed at which the high pressure hose 20 enters the pipe 24. The adjustable spring loaded clamp arm 72 allows for clamp adjustments to suit variations in high pressure hose 20 size and interior surface conditions in the pipe 24. The adjustable spring loaded clamp arm 72 employs a pull clamp handle 74; latch tensioner 76; a shaft 78, being pivoted at one end and the other end being threaded; a compression spring 80, to maintain tension on the clamp arm 72; and adjustment nut 82 to increase or decrease the tension on spring 80, by threadably engaging the threaded end of shaft 78.

Figure 5:
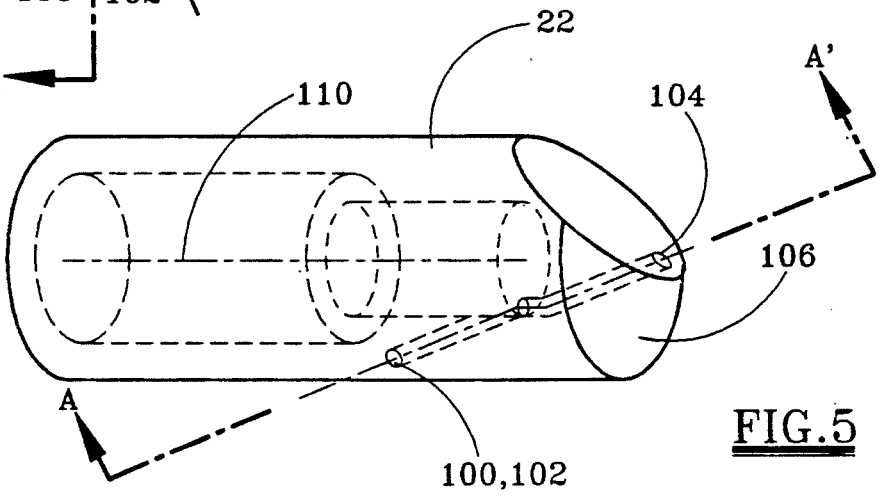
FIG. 5 is a cross-sectional view of the bias nozzle arrangement.

In FIG. 5, one embodiment of the biased nozzle 22 is depicted. Nozzle 22 is a uniquely shaped nozzle, specially designed to be used with the rotating hose device 10 and is generally of a cylindrical shape and having a combination of flat, beveled, pointed or rounded head members 106, 114, 120, 134, as depicted in FIG. 9, FIG. 10, FIG. 11 and FIG. 12. As depicted in FIG. 5, nozzle 22 has three or more jets 100, 102, 104. A plurality of three of more jets 100, 102, 104, positioned as shown in FIG. 5, FIG. 6, FIG. 7 and FIG. 8, ensures that the nozzle 22 will not be centrally located within the pipe 24, and that nozzle 22 is pressed against the interior wall of pipe 24. By constantly pressing the nozzle 22 against the interior wall of pipe 24, nozzle 22 produces optimum cleaning and significantly reduces the "streaking" effect left by prior art nozzles. As depicted in FIG. 5, Nozzle 22 has at least two lower jets 100, 102 which point away from the head of the nozzle 22 and one upper jet 104, which points generally in the direction of the head 106 of the nozzle 22. FIG. 5 shows a first imaginary horizontal line 110, which is a central line which bisects nozzle 22.

Figure 6A:
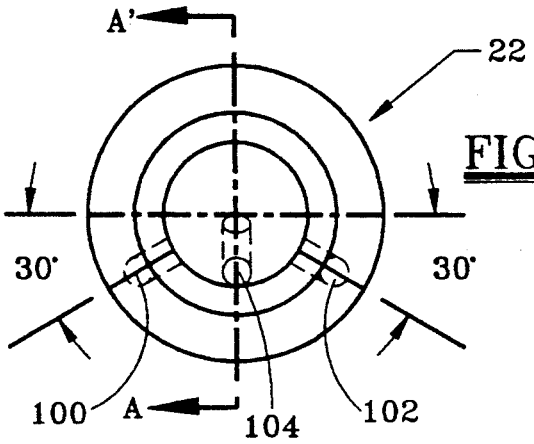
FIG. 6(A–C) illustrates embodiments of the bias nozzle of the present invention with differing jet positions.
Figure 6B:
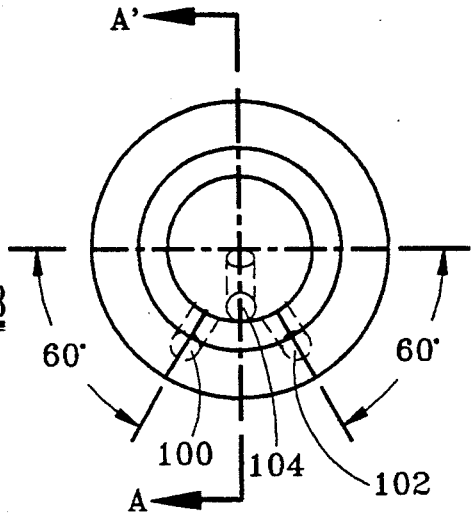
Figure 6C:
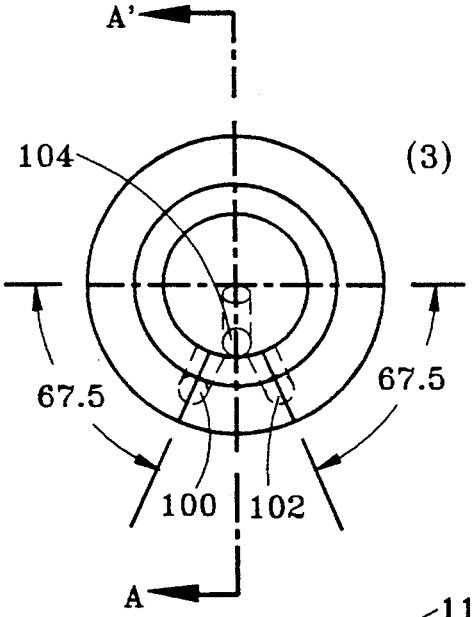

Referring to FIG. 6, a plan view of nozzle 22 looking down at the head 106 of nozzle 22 is illustrated with the lower jets 100, 102 positioned 30 degrees to 67.5 degrees from a second imaginary line 108. In FIG. 5*b*(1), lower jets 100 and 102 are positioned 30 degrees from horizontal line 108. In FIG. 7(2), lower jets 100 and 102 are positioned 60 degrees from horizontal line 108. In FIG. 7(3), lower jets 100 and 102 are positioned 67.5 degrees from horizontal line 108. The positioning of jets 100, 102 in FIG. 6(1), (2) or (3), depends upon numerous variables including pipe diameter, surface conditions, length of pipe to be cleaned and type of deposits or coatings. Referring to FIG. 7, lower jets 100, 102 can be positioned 30 degrees to 60 degrees from horizontal line 110. In FIG. 7(1), jets 100, 102 have been positioned 60 degrees from horizontal line 110. In FIG. 7(2), jets 100, 102 have been positioned 30 degrees from horizontal line 110. The positioning of jets 100, 102 with respect to horizontal line 110, FIG. 7(1) and (2) depends upon the same considerations as earlier mentioned: pipe diameter, surface conditions, length of pipe to be cleaned and type of deposits or coatings. In FIG. 8, the upper jet 104 can be positioned 30 degrees to 60 degrees from horizontal line 110. In FIG. 8(1), upper jet 104 has been positioned 30 degrees from horizontal line 110. In FIG. 8(2), upper jet has been positioned 60 degrees from horizontal line 110.

Figure 9:
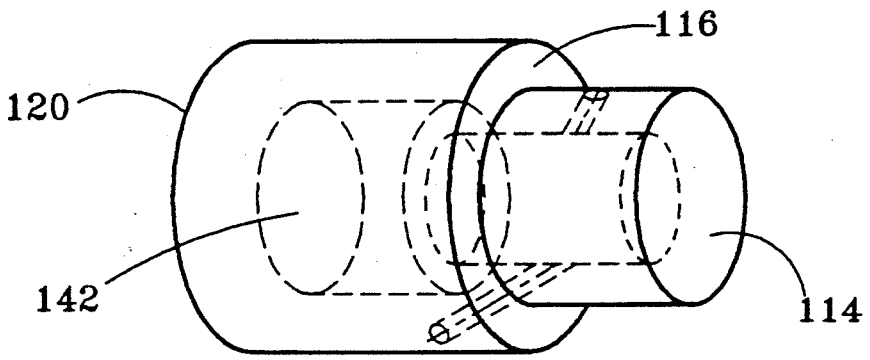
FIG. 9 illustrates another embodiment of the bias nozzle of the present invention with a domed top.
Figure 10:
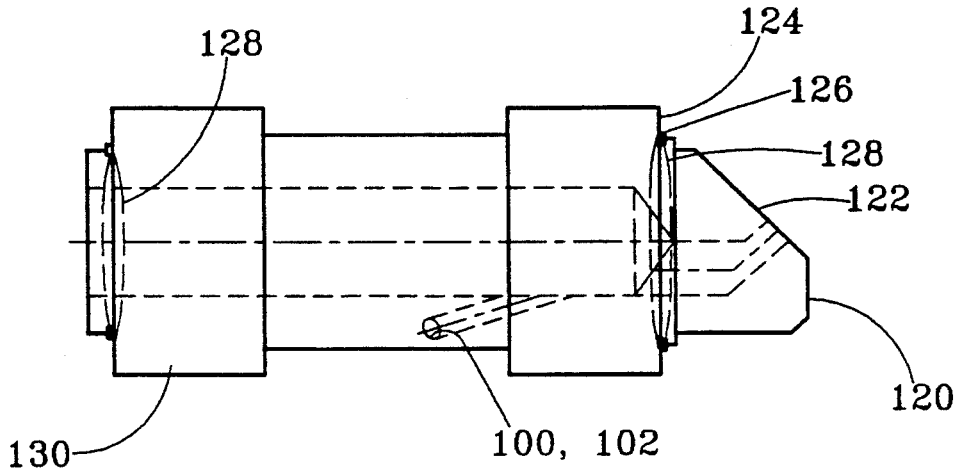
FIG. 10 illustrates another embodiment of the bias nozzle of the present invention with a flat top.
Figure 11:
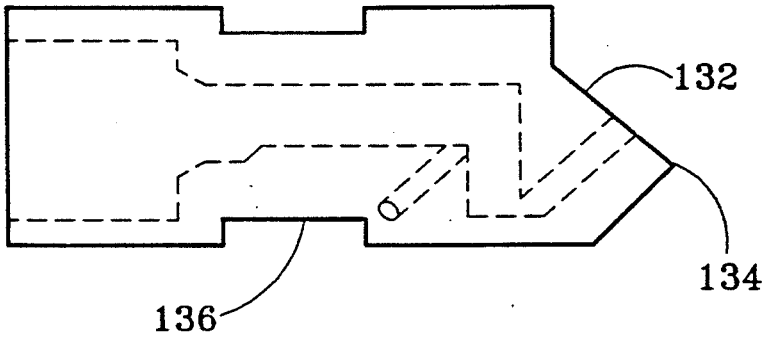
FIG. 11 illustrates another embodiment of the bias nozzle of the present invention with a pointed top.
Figure 12:
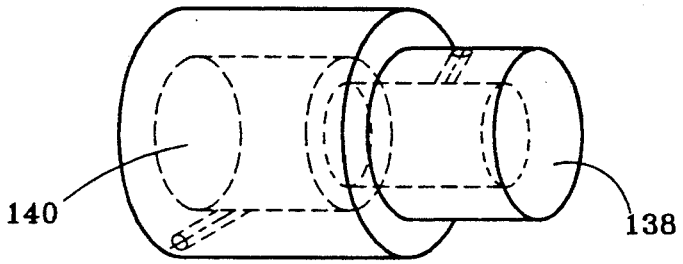
FIG. 12 illustrates another embodiment of the bias nozzle of the present invention.
Figure 13:
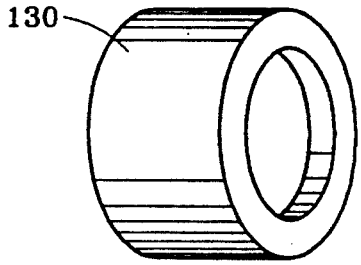
FIG. 13 illustrates a protective cover of the present invention.
Figure 14A:
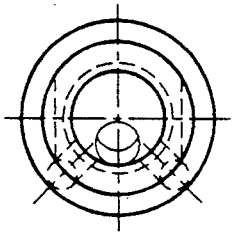
FIGS. 14 through 21 illustrate another embodiments of the bias nozzle of the present invention.
Figure 14B:
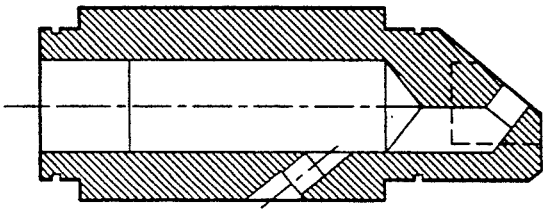
Figure 15A:
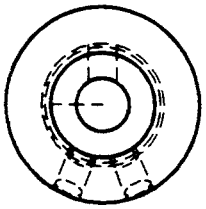
Figure 15B:
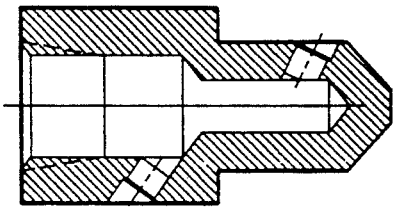
Figure 15C:
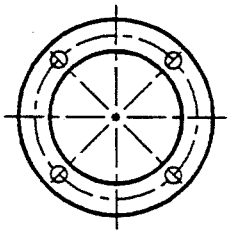
Figure 16A:
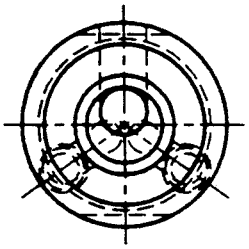
Figure 16B:
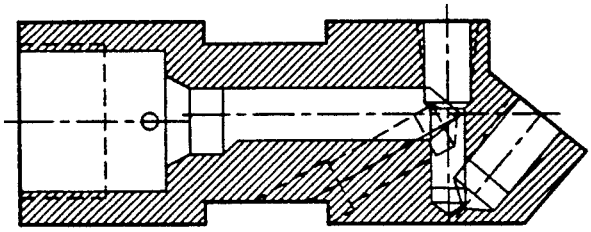
Figure 17A:
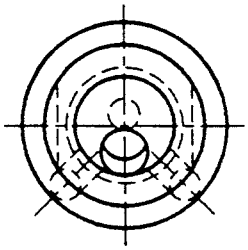
Figure 17B:
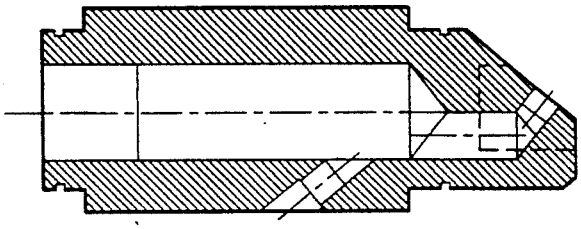
Figure 18A:
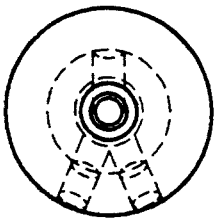
Figure 18B:
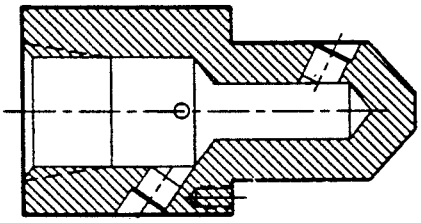
Figure 18C:
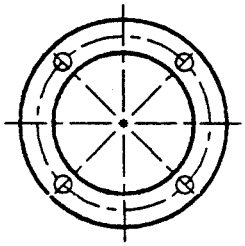
Figure 19A:
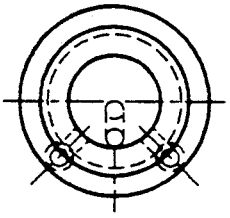
Figure 19B:
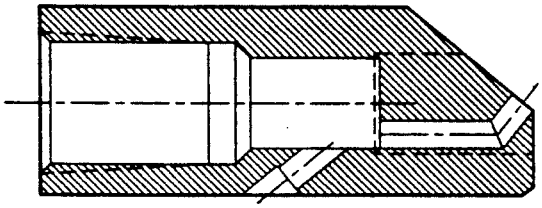
Figure 19C:
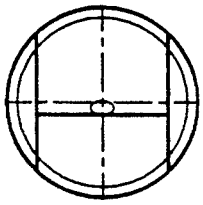
Figure 20A:
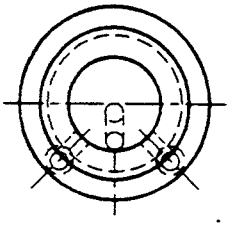
Figure 20B:
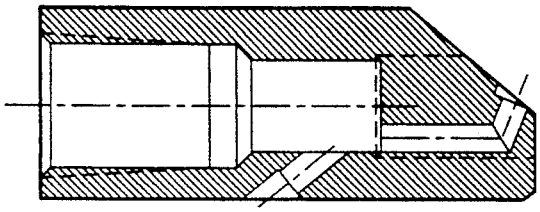
Figure 20C:
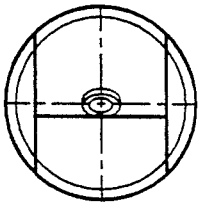
Figure 21A:
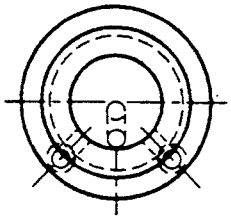
Figure 21B:
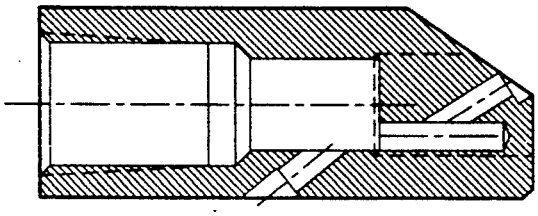
Figure 21C:
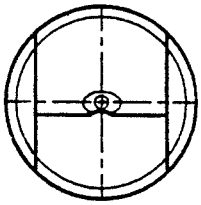

The nozzle 22 may also have alternate embodiments as shown in FIG. 9, FIG. 10 and FIG. 11. FIG. 9, a biased nozzle 112 having a rounded top or dome 114, distinctive shoulders 116 and thicker walls. FIG. 10 is a flat-topped, bias nozzle 118, having a flat top 120, beveled side 122, distinctive shoulders 124, jets 100, 102 are recessed and not flush with the circumference of nozzle 118, and nozzle 118 has notches 126 to hold retaining rings 128 and protective cover 130 (See FIG. 13). FIG. 11 is a biased nozzle 132 with a pointed head 106 and having a wide central notched band 136. FIG. 12 illustrates a nozzle 138, which is similar to the nozzle 112, with the exception that the fluid inlet chamber 140 is of a much larger diameter than the fluid inlet chamber 142 of nozzle 112 (See FIG. 9). FIG. 13 depicts a protective cover 130, which can be composed of a variety of polymers or metals. The protective cover 130 absorbs the shock and friction created when the nozzle 22 or any alternate embodiments 112, 118, 132, 138 encounter the interior surface of the pipe. The protective cover 130 is a band-like cover which protects nozzle 22 and alternate nozzle embodiments 112, 118, 132, 138.

What is claimed is:

1. A rotating hose device for cleaning an interior surface of a tubular member, comprising:

(a) a rotary hose drive having a plurality of variable pitch drive wheels and an adjustable spring loaded clamp arm to grip a high pressure rotating hose and provide for variations in the high pressure hose diameter and exterior hose surface conditions, wherein the drive wheels converts a rotary torque of the high pressure rotating hose into a linear thrust to urge the high pressure rotating hose and a biased cleaning nozzle into a tubular member at a non-parallel angle, the variable pitch drive wheels are positioned to cause the high pressure rotating hose and biased cleaning nozzle to enter the tubular member in a screw-like manner to effect a complete cleaning of the interior surface of the tubular member without streaking the interior surface of the tubular member;

(b) a rotary union drive for supplying a high pressure fluid from a non-rotating conduit to the high pressure rotating hose;

(c) a hydraulic power unit for supplying energy to a non-internal combustion power source, wherein the non-internal combustion power source transfers power from the hydraulic power unit to a swivel joint, for rotation of the high pressure rotating hose and the biased cleaning nozzle;

(d) a high pressure pump for supplying the high pressure fluid through the non-rotating conduit, the high pressure rotating hose and the biased cleaning nozzle; and (e) a rolling platform to house the swivel joint and the non-internal combustion power source.

2. The rotating hose drive of claim 1, wherein the biased nozzle contains a plurality of correctly sized and positioned jetting orifices which produce the required forces to position the nozzle against the interior surface of the tubular member to effectively clean the interior surface of the tubular member and prevent the nozzle from reversing direction in the tubular member.

3. The rotary hose drive of claim 1, wherein the adjustible spring loaded clamp arm selectively increases and decreases the pressure applied by the plurality of variable pitch wheels to the concentrically engaged high pressure rotating hose.

4. The rotating hose device of claim 1, wherein the high pressure rotating hose and biased cleaning nozzle are automatically inserted into the tubular member.

5. The rotating hose device of claim 1, further comprising a remote control means, wherein the device can be safely operated from a location removed from the tubular member, the rotary hose drive and the rotary union drive.

6. The rotating hose device of claim 1 wherein the rotary hose drive and the rotary union drive are light weight, portable and can be used in relatively small areas and elevated areas.

7. The rotating hose device of claim 1 wherein a standard size high pressure rotating hose and biased cleaning nozzle can be used on a variety of different sized tubular members.

8. The rotary hose drive of claim 1, wherein the adjustable spring biased clamp arm facilitates friction between the drive wheels and the rotating, concentrically positioned hose, wherein the drive wheels convert the torque of the rotating hose into linear thrust to urge the high pressure rotating hose and biased cleaning nozzle through the tubular member in a screw-like manner.

9. A rotating hose device for cleaning an interior surface of a tubular member, comprising:

(a) a drive, having a means for converting a rotary torque of a high pressure rotating hose having a biased nozzle, into a linear thrust to urge the rotating hose and biased nozzle into the tubular member at a non-parallel angle relative to the axis of the tubular member, wherein the rotating hose and biased nozzle enter the tubular member in a screw-like manner;

(b) a rotary union drive, having a swivel joint for transmitting fluid from a non-rotating source to the rotating hose, wherein the hose is revolved by said rotary union drive;

(c) a power source to rotate said rotary union drive;

(d) an energy source for supplying energy to the power source, wherein power is transfered from the power source to the rotary union drive to revolve the rotating hose and the biased nozzle; and (e) a rolling platform to house said rotary union drive and said power source, wherein said rolling platform rolls to and away from the tubular member.

* * * * *